United States Patent [19]

Lemelson

[11] Patent Number: 5,024,343

[45] Date of Patent: Jun. 18, 1991

[54] CONTAINER ASSEMBLY AND METHOD

[76] Inventor: Jerome H. Lemelson, 85 Rector St., Metuchen, N.J. 08840

[21] Appl. No.: 789,648

[22] Filed: Oct. 21, 1985

Related U.S. Application Data

[63] Continuation-in-part of Ser. No. 631,619, Jul. 17, 1984, abandoned.

[51] Int. Cl.[5] ..... B65D 7/00

[52] U.S. Cl. ..... 220/326

[58] Field of Search ..... 220/322, 323, 324, 326, 220/5 R

[56] References Cited

U.S. PATENT DOCUMENTS

| | | | |
|---|---|---|---|
| 2,836,400 | 5/1958 | Jackson | 220/5 R |
| 3,084,916 | 4/1963 | Scharmer et al. | 220/5 R |
| 3,250,423 | 5/1966 | Curran | 220/323 |
| 3,439,900 | 4/1969 | Gill | 220/326 |
| 4,257,527 | 3/1981 | Synder et al. | 220/5 R X |

*Primary Examiner*—Steven M. Pollard

[57] ABSTRACT

A container assembly including a plastic container formed by rotational casting in a multiple piece mold, particularly for use in tumbling and treating small articles such as in coating, electroplating, washing and cleaning such articles while the container is in rotational motion. An opening in the side wall of the container is provided after the container is molded and a closure is disposed thereacross. Portions of the side wall of the container are specially molded to retain one or more retainers, such as metal spring clips, in place against the closure to tightly hold the closure against the opening. In a particular form, one or more large gears are secured against the end walls of the container and access is had to the interior of the container as it operates, through respective end openings and tubular formations integrally molded with the end walls thereof.

19 Claims, 2 Drawing Sheets

CONTAINER ASSEMBLY AND METHOD

RELATED APPLICATIONS

This is a continuation-in-part of application Ser. No. 631,619 filed July 17, 1984 for Container Assembly and Method, now abandoned.

BACKGROUND OF THE INVENTION

1. Field of the Invention

This invention is in the field of container assemblies, particularly for use in chemical processing and treating small articles of manufacture contained therein. Such containers are generally rotated during the chemical or physical finishing of articles held in the container while the liquid, such as a plating solution, is either caused to flow through a multitude of small holes or openings in the wall of the container or is retained within the container during processing.

2. Description of the Prior Art

The prior art consists of containers and container assemblies which are formed of a plurality of plastic sheets or plates cut to the shapes of rectangles, assembled and retained together while they are edge-welded by means of a flame torch. The containers are complex and costly to produce and pose a primary problem involving separation or damage along the weld lines or seams caused by vibration, welding and shock attrition.

SUMMARY OF THE INVENTION

This invention relates to improvements in drums and barrels which are molded of plastic, particularly for use in chemically treating and plating small articles of manufacture while disposed therein.

It is known in the art to form multi-faceted plating drums and the like of plastic by fabricating same of a plurality of rectangular panels which are cut from plastic sheet and which are welded along their edges while retained in a fixture and secured by welding to respective end walls, also made of plastic, to define an elongated container capable of being axially supported from above and rotated while in or above a chemical solution to cause the article therein to tumble and such solution to circulate or pass into the drum through small openings in the wall thereof. In addition to requiring substantial labor to assemble and weld the plastic drum components together in order to fabricate such a plating drum, such drums suffer a number of important shortcomings and disadvantages, a primary of which is the fact that stresses due to loading and shock during use cause failures along the weld lines or seams which require substantial additional labor to repair.

Accordingly it is a primary object of this invention to provide a new and improved plastic container in the form of a barrel or drum which may be utilized for plating and tumbling purposes.

Another object is to provide an improved plating drum assembly including a unitary plastic drum, wherein such assembly contains a minimum number of components.

Another object is to provide a plating drum assembly constructed so as to eliminate seam welding of the walls thereof, thereby reducing the possibility of wall failure.

Another object is to provide a plastic drum for use in plating articles and the like and having a removable cover extending across an opening in the wall of the drum wherein the drum wall is externally shaped by molding to receive and retain a plurality of spring-clamps in assembly therewith and providing forced engagement and retention for the cover thereof.

Another object is to provide a container having a multi-faceted side wall molded to shape in a two-piece mold and formed with four or more flat wall portions wherein such container is provided with spring-clamp retaining formations molded integral with the side wall at respective junctions of the flat portions thereof.

Another object is to provide a plastic container formed by rotational casting in a two-piece mold and having a plurality of lip-like wall formation at space-apart locations of the side wall for retaining the shaped ends of a plurality of spring-clamps wherein such lip-formations are specially shaped and disposed to permit the container to be properly rotationally cast and removed from the mold.

Another object is to provide new and improved assemblies including rotationally cast containers with reinforcing means therefor.

Another object is to provide an improved drum-like structure formed entirely by casting or molding a plastic resin, having a multi-faceted side wall for tumbling article therein and end-walls integral with such side wall containing respective aligned molded tubular formations, for receiving, aligning and retaining respective gears or fittings shaped to support the assembly from above and to effect the rotation thereof during use.

Another object is to provide improvements in plating barrel assemblies which include containers which are not made of welded construction and thereby are not subject to weld failure and separation during use.

Another object is to provide an improved plating barrel assembly which includes a unitary molded plastic drum having outwardly extending integrally molded tubular formations protruding from the end walls of the drum, through which flexible cable electrodes may be passed to the interior of the drum for plating purposes.

Another object is to provide a plating barrel assembly including a rotationally cast plastic drum having one or more longitudinally extending reinforcing members secured therein so as to minimize the required wall thickness of the drum.

Another object is to provide a rotationally cast container with reinforcing members molded integral with a wall or walls thereof.

With the above and such other objects in view as may hereinafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

Figure 1:
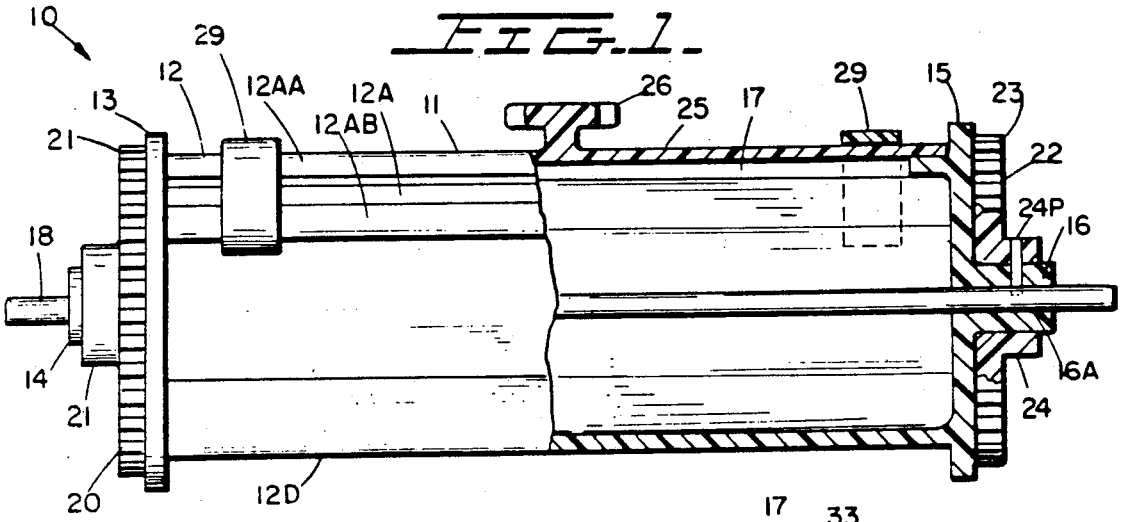
FIG. 1 is a side view with parts broken away and sectioned for clarity of a plating barrel assembly including rotating gears and a removable cover, wherein the container portion of the assembly is formed by rotational molding.
Figure 3:
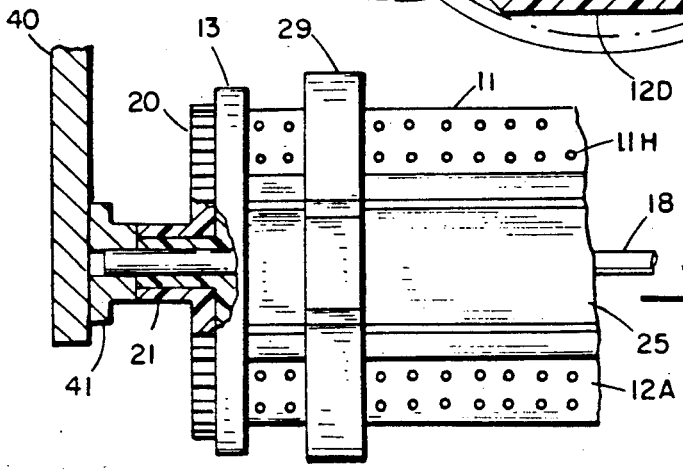
FIG. 3 is a partial side view of a plating barrel assembly and an overhead conveyor support with parts of the support and barrel cut away and sectioned for clarity.

There is shown in FIG. 1 a plating barrel assembly 10 formed of an elongated molded container 11 having a side wall portion 12 of octagonal cross-section and containing eight substantially planar side walls denoted 12A to 12H with two disc shaped end walls 13 and 15. Protruding outwardly a distance beyond the end walls 13 and 15 are respective integral tubular formations 14 and 16 which are axially aligned with each other and are preferably molded aligned with the central longitudinal axis of the container 11. Extending longitudinally through the center of the container 11 and the passageways 16A of the tubular formations 14 and 16 is a rigid rod or tube 18 which is preferably made of stainless steel or other corrosion resistant material which serves to support the barrel assembly when the ends of such member 18, which protrude from the ends of the tubular formations 14 and 16 are retained by legas of an overhead carriage or frame as shown in FIG. 3. The container 11 is preferably formed of a unitary plastic casting or molding of a resin, such as high density polyethylene, by means of a molding process, such as rotational molding, wherein powdered thermoplastic resin is charged into a two piece mold and the mold is rotated and oscillated while it is heated in a manner to distribute and melt the plastic about the inside surfaces of the mold cavity against which the molten plastic is solidified into a hollow container. The elongated rod or tube 18 may be disposed in the mold across the mold cavity, as taught in my U.S. Pat. Nos. 3,875,275 and 4,043,721 to become integrally secured to the end walls 13 and 15 and their tubular formations 14 and 16 when the molding material sets against the corresponding portions of the elongated member.

The upper or top wall 12H of the container 11 is shown with a rectangular opening 17, which is formed by cutting away material of the wall leaving a shelf 17S against which a rectangular flat cover 25 may be disposed to permit articles to be plated otherwise processed to be admitted to and removed from the barrel. The cover 25 contains a handle 26 and is held flush against the rim shelf 17S by two clamps 29 and 29A which are preferably made of spring steel coated with a vinyl plastisol to prevent corrosion of steel. The clamps are preferably secured at their ends which extend over and around specially formed portions of the side wall portions 12A and 12G as shown, for example, in FIG. 2.

Secured and centered flush against the flat outer surfaces of the disc-shaped end walls 13 and 15 are respective circular spur gears 20 and 22, the teeth 21 and 23 of which are shaped to engage respective teeth or matching spur gears which define a drive train supported by a fixture (not shown) to cause the barrel to rotate as it is moved longitudinally by an overhead conveyor, so as to tumble the contents thereof. Each gear may be welded or secured with fasteners to the respective end wall, 13 or 15, against which it is disposed. The gears 13 and 15 are preferably machined of plastic, such as a polyamide, and contains a respective tubular hub, denoted 21 and 24, which hubs are slidably supported on the tubular extensions 14 and 16 of the end walls 13 and 15. A pin or fastener 24P is shown passing through holes in the hub 24 and tubular wall extension 16 and is retained in a cavity in shaft 18 to secure the gear 23 in place although welding or fastening to the end wall may suffice to secure the gears in place.

Figure 2:
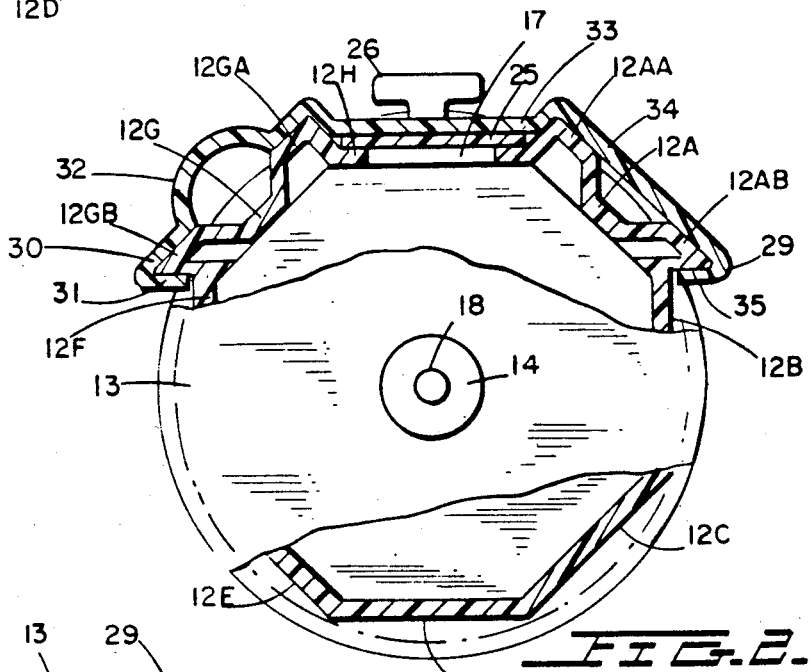
FIG. 2 is an end view of a modified form of the barrel of FIG. 1 with a gear removed from assembly against the end wall and the end wall partly broken away and parts sectioned for clarity.

In FIG. 2 details of the clamp 29 and the shape of portions of the side wall of the container 11 are shown. Clamp 29 is formed with acutely angled end portions 31 and 35 which are adapted to extend over and around respective protruding portions 12GB and 12AB of the upper side wall portions 12G and 12A of the container 11. Such protruding formations may extend the length of the drum or barrel, as shown in FIG. 1 or may be formed only along select portions of the drum wall. Together with upper protruding formations 12AA and 12GA, which may also extend the length of the drum up to the disc shaped end walls thereof as shown in FIG. 1, such protruding formations serve to permit the clamps 29 and 29A to properly deform and compressively engage the surfaces of the wall portions 12G and 12H to compressively engage the outer surface of the cover or lid 25 and force same against the shelf 17S, as shown in FIG. 1 to retain the cover tight thereagainst.

Each clamp 29 is formed with a first end portion 30 which includes a lip 31 formed at an acute angle and an arcuate formation 32 which extends away from the wall of the container and serves as a handle for removing the clamp by hand. The central portion 33 of the clamp is flat and is adapted to engage the cover 35 forcing it against the shelf 17S. The other end 34 of the clamp is flat, extends across the formations 12AA and 12AB of the wall portion 12 and is formed with an end lip 35 at an acute angle thereto which is adapted to extend over and around the far edge of the formation 12AB as shown.

While the irregular formations in the sidewall portions 12A and 12G are shown as protruding substantially outward from the side wall of the container or drum 11 and extending the length of the drum, they may be less pronounced than shown and may extend for select lengths of the drum side wall. They may also be cast to shapes different than illustrated and may be formed by machining or drilling through select portions of the side wall.

In FIG. 3 is shown further details of the tumbling drum or barrel of FIG. 1, supported at its ends from above for rotation in or above the tank or liquid. One end of shaft 18 is shown rotationally supported in an open bearing or bushing 41 which is secured to the end of an arm 40 which forms part of an overhead assembly suspended from and supported by an overhead conveyor. Similar support is provided at the other end of shaft 18 (not shown) to rotationally support the drum or barrel assembly from above.

Figures 4, 5, 6, 7:
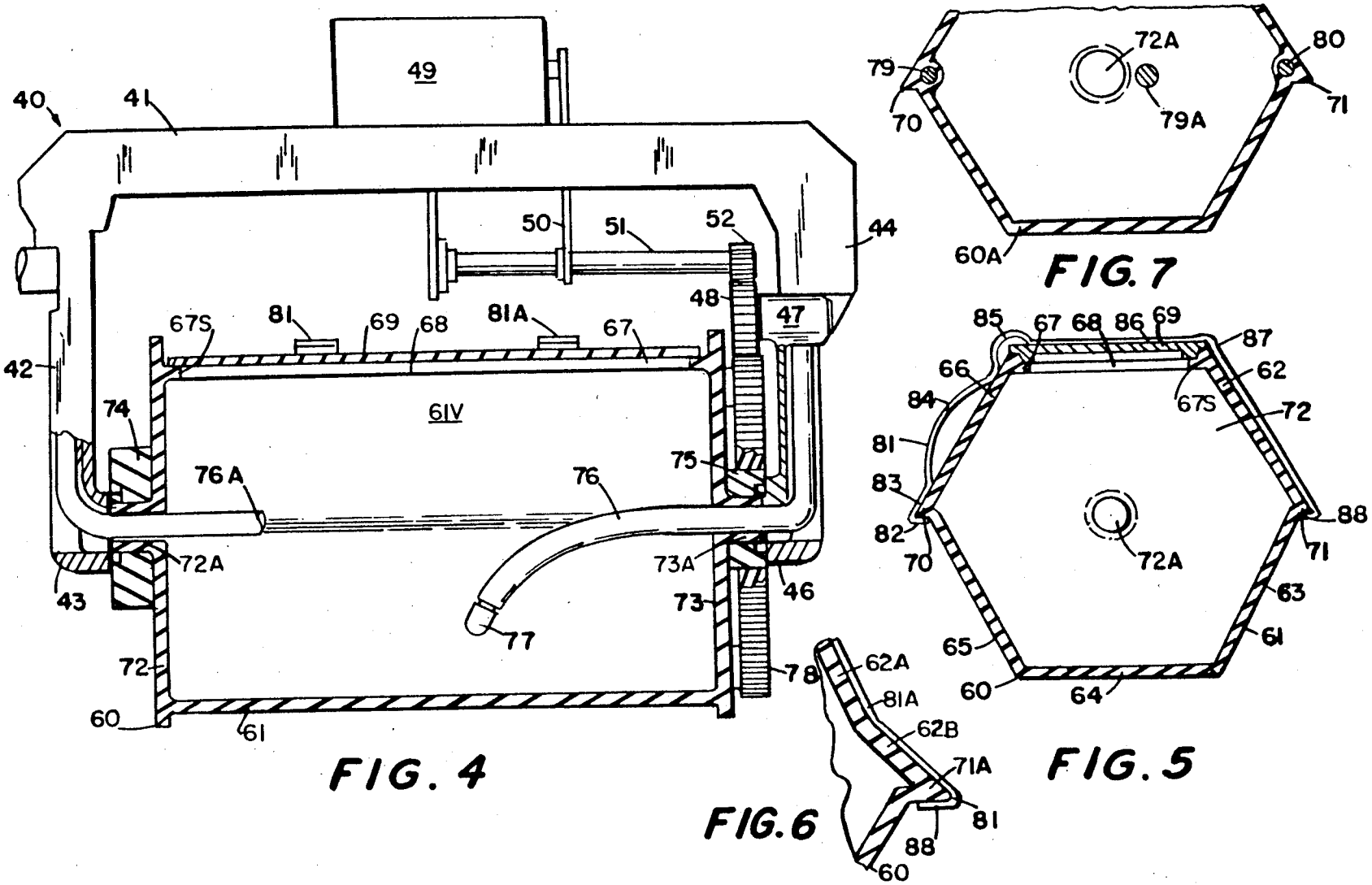
FIG. 4 is a side view with parts broken away and sectioned for clarity of plating barrel or drum assembly including an overhead support and rotating means for the drum thereof.
FIG. 5 is an end view in cross section of a portion of a molded drum of the type shown in FIG. 4.
FIG. 6 is a partial end view in cross section of a portion of the drum of a modified form of the drum shown in FIGS. 4 and 5.
FIG. 7 is a partial end view in cross section of a plating barrel which is a modified form of that shown in FIG. 5.

In FIG. 4 is shown details of an assembly 40 which includes a plating barrel assembly 60 formed of a unitary plastic molding 61 defining a multi-faceted container 61 which is pivotally supported from above by means of a carriage 40 including a U-frame 41 which is adapted to travel an overhead track or hang from an overhead travelling conveyor (not shown). Downwardly subtending side legs 42 and 44 of the U-frame 41 each have lower portions 43 and 46 thereof which couple to and retain end portions of the drum or barrel assembly 60 in a manner to permit such barrel assembly to be rotationally driven about its central axis which passes through the center of two aligned tubular formations 72A and 73A which extend outwardly from respective flat end walls 72 and 73 of the container 61.

Container 61 is preferably formed of a unitary construction by rotationally molding a suitable rigid plastic material, such as high density polyethylene charged into a two-piece rotational mold having a parting plane passing through the central axis of the container. The container 61 is illustrated in FIGS. 5 and 7 as having six flat side wall portions denoted 62, 63, 64, 65, 66 and 67, each being of substantially rectangular shape and defining a unitary side wall defining an enclosed volume 61V in which small articles, such as fasteners, stampings, small castings or otherwise formed metal parts may be charged and disposed in a manner to slide and to tumble therein as the container is slowly rotated about its central, horizontal axis. As shown in FIG. 5, which is an end view in cross section of a modified form of the container illustrated in FIG. 4, the topmost facet or wall 67 of the container has a rectangular opening 68, preferably extending most of the length and width of such wall and formed by means of a saw or otherwise operable cutting tool applied to cut the wall and provide the opening 68 therein leaving a circumscribing shelf 67S portion of the wall against which the border portion of the cover 69 may be held by a plurality of elongated and specially shaped clamping devices 81 and 81A which will be described. Shown secured to the outer surface of the end wall 72 is a collar or bushing 74, preferably made of molded or machined plastic and defining a large annular ring-like formation, the inside diameter of which is adapted to frictionally or slidably engage against the outside surface of the tubular extension 72A of the end wall 72. Such bushing 74 is preferably cemented or welded to both the outer surface of the end wall 72 and the outer surface of the tubular formation 72A which is shown extending to the outer face of the bushing. The tubular formation 72A is thus supported by the bushing 74 which is shaped with an annular cavity formed therein outwardly of the inner surface of the bushing and is provided to receive an inwardly protruding end formation 43 of the lower end of the side leg 42 of the U-frame 41. Such formation 43 is annular in shape and is adapted to be slidably disposed within the annular channel 74A formed in the outer face of the bushing 74 so as to support such bushing and the container 61 to which it is attached in a manner to permit the container to be rotationally driven about its horizontal or longitudinal axis which passes through and defines the central axis of the extension 72A of the end wall 72 of the container.

At the other end of the container 61 is shown a second bushing 75 which may also comprise a hub of a large spur gear 78 which is pinned, welded, adhesively bonded or otherwise fastened to the end wall 73 of the container 61 and serves as a means for rotationally driving such container around its longitudinal or horizontal axis when the gear 78 is properly power rotated. Such power rotation is effected by means of a gear train comprising a first gear 48 supported for rotation on a shaft (not shown) which is rotationally supported by a pillow-block 47 mounted against the leg 44 of the U-frame assembly 41. A constant speed electric motor is provided in the housing 49 and is mounted on top of the assembly defining the frame 41 and such motor is operable to drive a horizontal shaft 51 supported beneath the frame, as shown, through an endless gear or belt supported within a housing 50, which housing also supports a bearing for supporting the shaft and a pulley or sprocket wheel on the shaft (not shown). A small gear 52 is provided on the end of shaft 51 which engages the teeth of gear 48. Gear 48 engages a large spur gear 78 which is secured to the end wall 73 of the container 61 causing the container assembly 60 to be rotated about a horizontal central axis when the motor in the housing 49 operates.

The spur gear 78, which is almost the diameter of the container 61, has a hub 75 which may be integrally formed at the center of the gear disc or may be assembled in a central bore of the gear disc, welded thereto and bonded or welded to the outside surface of the end wall 73 and to the peripheral surface of the tubular extension 73A of the end wall. The gear 78 may also be pinned, bonded with adhesive or welded to the outer portion of the end wall 73 and is shown supported a brief distance from the outer surface of such end wall by an annular ring 78R or laterally extending circular portion of the gear base.

Extending downwardly along or through the side leg 44 of the frame 41 is a cable 76 which passes through the central opening of the extension 73A of the side wall 73 and terminates within the internal volume 61V of the container 61. The cable 76 contains a copper wire or a plurality of such wires which are connected to a source of plating electrical energy which is passed to metal articles disposed in the container 61, when a metal tip 77 connected to the end of such wire or wires in the cable 76 dangles downwardly within the volume 61V against the contacting and tumbling metal articles. The entire side wall of the container, which is illustrated in FIGS. 5 and 7, is preferably perforated or drilled with a multitude of small holes permitting liquid, such as electrolyte and/or washing solution or water, to pass into and out of the interior volume 61V of the container.

Further details of the container assembly 60 are illustrated in FIG. 5 and include details of the shape of the spring metal clamp 81 and the exterior shape of the side wall of the molded container 61 permitting such spring clamp to be removably retained in place over and around the upper half of the container for holding the cover in place across the opening 68 in the top wall 67 of the container. The clamp 81 is preferably formed of a strip of spring steel or copper coated with a protective material, such as a vinyl plastisol or a strip of spring stainless steel. One end 82 of such strip is formed at an acute angle to the next portion 83 thereof which is deformed with an arcuate central portion 84 which bows outwardly from the side panel or wall portion 66 of the container. The next portion 85 of the spring clamp 81 is then deformed into a somewhat semi-circular shape and extends to a flat retaining portion 86 which extends across the cover 69 and is bent or deformed at an angle and extends to a second flat portion 87, the end portion of which is deformed or bent at an acute angle similar to the angle portion 82 extends from its adjacent portion 83.

To accommodate and retain the spring clamp tightly against and around the upper portion of the container, the side wall portions 62, 63 and 65, 66 of the container are formed along their common longitudinal edges with respective overhanging, lip-like formations 71 and 70 which protrude outwardly from the lower side walls 63 and 65 of the container. Such container wall structure in which the overhanging lip-like formations 70 and 71 are provided where respective walls 65, 66 and 62, 63 join and define a wall configuration which may be molded in a conventional two-piece rotational mold wherein the molding 61 may be removed from such mold due to the lack of undercuts in the molding. In other words, the lip-like formations or shells 70 and 71 are formed along the parting line of the mold and thus do not define molding undercuts.

A modified form of such lip-like formations, is illustrated in FIG. 6. Whereas in FIG. 5 the side wall portions 62 and 66 are substantially flat or planar, in FIG. 6, the side wall 62 is shown shaped with a flat upper portion 62A and an angulated lower portion 62B in the vicinity of the overhanging lip formation 71A at the junction of the side wall portions 62 and 63. The spring strip or clip 81A shown conforming to the outer surfaces of the upper and lower side wall portions 62A and 62B while the end 88 of such clip extends against the bottom surface of the lip-like formation 71A. A similar construction and assembly may be provided at the other side of the container in the vicinity of the junction of the upper and lower side wall portions 66 and 65.

In FIG. 7 is shown a modified form of the container structure shown in FIG. 5. Three reinforcing metal rods are illustrated which are secured to the walls of the container by molding. Two metal rods 79 and 80 are shown encapsulated within the mold wall material at the junctions of the side wall portions 65, 66 and 62, 63. Such rods may serve to stiffen and support the container and may be so encapsulated by disposing the rods across the cavity of the rotational mold in which the container 60A is molded to shape. Being that the rods 79 and 80 are located in the vicinity of the overhanging lip-formations 70 and 71 which are located along or near the parting line of the mold, such rods may be disposed completely across the mold cavity and retained in sub-cavities thereof beyond the end surface of the mold which define the outer surfaces of the end walls 72 and 73 of the molding.

A third rod, denoted 79A, is shown extending close to the central tubular formation 72A protruding outwardly from the end wall 72 of the container molding 61. Such latter rod may also be disposed to extend across the mold cavity prior to molding and may be supported at its ends in sub-cavities formed along the parting plane of the mold so as to permit the ends of the rod to extend through the end walls 72 and 73 of the molding to be supported thereby and to support the end walls against bending or warpage which may be caused by the load carried by the container. A plurality of such rods 80A may extend parallel to each other across the mold and along a plane extending horizontally and through the central axis of the container wherein each of such rods provides additional longitudinal support of the container and has its ends attached by molding to the end walls of the container.

Notation 76A refers to a second cable extending through the central passageway in the tubular extension 72A of the end wall 72 and serves as a negative electrode for receiving current from the positive electrode when its exposed head (not shown) contacts the metal articles or material within the container a distance away from the positive electrode defined by the head 77 of the cable or dangler 76.

As in the embodiments of FIGS. 1–3, the side walls and covers for the containers illustrated in FIGS. 4–7 are preferably perforated by drilling small holes 1/32" to ⅛ in diameter therethrough at spacing of 14" to ½ to permit liquid, such as plat-solution and water, to pass into and out of the container when the container is conveyed to and lowered into a tank of same.

What is claimed is:

1. In a molded plating barrel container having a side wall formed with a plurality of facets extending substantially the length of said container and joined along their longitudinal edges, and respective end walls forming an integral and unitary molded plastic structure and wherein said side wall is provided with an opening in one of the facets thereof for charging and emptying said container, the improvements comprising:

(a) a removable closure extending across said opening in said side wall of said container, (b) at least one elongated spring-like retainer for holding said closure in engagement with said container side wall across said opening, said spring-like retainer having a central portion and respective end portions extending at acute angles to said central portion, (c) said side wall of said container being formed with a plurality of retaining formations shaped for receiving and holding respective of said end portions of said retainer, each of said retaining formations being integrally molded as an extension of a respective facets of the side wall of said container, said molded retaining formations being located diametrically across said said container on opposite sides of said opening in said side wall so as to permit a retainer having its ends engaging respective of said retaining formations to cause the central portion wall of the container.

2. A container assembly in accordance with claim 1 wherein two respective pairs of said facets of said side wall of said molded container are shaped where joined in a manner to define respective of said retaining formations.

3. A container assembly in accordance with claim 1 wherein the side wall of said container is symmetrically shaped with respect to two planes at right angles to each other with one of said planes extending at a right angle to the facet containing said opening, the other plane defining the parting line of the molded container and passing through respective of said retaining formations on opposite sides of said container.

4. A container assembly in accordance with claim 2 wherein said retaining formation define respective lip-like formations which are formed by molding and protrude outwardly from said side wall at the junctions of respective pairs of said facets forming said side wall of said container.

5. A container assembly in accordance with claim 2 wherein said retaining formations define respective shelves overhanging respective pairs of facets of said side wall of said container there being surfaces of each of said retaining formations against which respective of said end portions of said retainer may be retentively engaged to hold said retainer assembled to said container with its central portion deformed and serving to cause the end portions thereof to be spring biased against said surfaces of said retaining formations of said container.

6. A container assembly in accordance with claim 1 wherein the facets defining the side wall of said container are substantially equishaped and are each rectangular in shape, said retaining formations being formed at the junctions of respective opposite pairs of said facets of said side wall of said container.

7. A container assembly in accordance with claim 1, wherein said retaining formations are elongated in shape and each extend substantially the length of the side wall of said container parallel to each other.

8. A container assembly in accordance with claim 1 wherein said molded retaining formations extend parallel to each other along the side wall of said container and protrude outwardly therefrom a degree to respectively receive and retain respective the acutely angled end portions of said elongated retainers thereagainst.

9. A container assembly in accordance with claim 1 in which said container end walls are each shaped with a respective tubular formation, which tubular formations extend outwardly from said end walls and are axially aligned with each other.

10. A container assembly in accordance with claim 9 including respective reinforcing members secured to said container and surrounding said tubular formations.

11. A container assembly in accordance with claim 10, wherein said reinforcing members contain respective hubs engaging and surrounding said tubular formations and are each secured to respective portions of said end walls of said container.

12. A container assembly in accordance with claim 11 wherein one of said reinforcing members is a circular gear having peripheral gear teeth formed therein, the hub of said gear surrounding one of said tubular formations.

13. A container assembly in accordance with claim 12 including means for securing a side wall of said gear to that end wall of said container adjacent which said gear is supported.

14. A container assembly in accordance with claim 1 including an overhead support for said container having a U-frame with side legs extending downwardly from said support, means for supporting said support from above, and means for coupling said side legs to the ends of said container to permit said container to rotate therebetween, a large spur gear secured to one end wall of said container, gear means rotatably supported by said U-frame and a motor supported by said frame and connected to drive said gear means, said gear means being coupled to drive said spur gear when said motor operates.

15. A container assembly in accordance with claim 1 including an elongated reinforcing member extending across the interior of said container and having its ends secured to respective end walls of said container.

16. A container assembly in accordance with claim 15 wherein said reinforcing member is at least partly embedded in a portion of at least one wall of said container.

17. In a molded plating barrel container having a side wall formed with a plurality of facets of substantially rectangular shape, said facets being joined along their longitudinal edges and extending substantially the length of and parallel to a central longitudinal axis of said container, said container having respective end walls molded integral with said side wall and forming an integrally molded structure, an opening provided in one of said facets of said side wall through which opening small articles may be admitted to said container and removed therefrom, the improvement comprising:

(a) a removable closure extending across said opening and engaging the rim of said side wall surrounding said opening, (b) a plurality of elongated spring-like retainers for said closure, each having a central portion and end portions extending at respective acute angles to the central portion thereof, (c) said side wall of said container being molded with a plurality of retaining formations for retaining the end portions of said elongated spring-like retainers thereagainst with the central portions of said retainers deformed and forcibly engaging said closure with a force sufficient to hold said closure in place against the side wall of said container and across said opening, (d) the end walls of said container also being molded with respective open tubular formations which are axially aligned with each other and said central axis of said container, and which respectively protrude outwardly from respective of said end walls, and (e) respective reinforcing members secured to each of said end walls and engaging said tubular formations, at least one of which reinforcing members comprising a circular spur gear which is operable, when driven, to rotate said container about its longitudinal axis.

18. In a molded container having a side wall formed of a plurality of facets extending the length of the container and operable for causing small articles disposed in the container to tumble when the container is rotated about a longitudinal axis extending parallel to said facets and respective end walls forming an integral molded structure and having an opening in one of said facets, the improvement comprising:

a) each of said end walls of said container having a respective tubular formation integrally molded and extending outwardly from its end wall with the axis of such tubular formations aligned with each other and defining a central longitudinal axis for said container, b) at least one circular gear formed with a hub, said gear engaging the outer surface of one of said tubular formations so as to dispose said gear with its central axis being substantially the central axis of said container, c) means for securing said circular gear to the end wall of said container adjacent which said gear is disposed on the tubular formation which is molded integral with said end wall with the central axis of said circular gear comprising the longitudinal axis of said container; and d) a bushing secured to the other end wall of said container and surrounding the other of said tubular containers.

19. In a molded container having a side wall formed of a plurality of facets extending the length of the container and operable for causing small articles disposed in the container to tumble when the container is rotated about a longitudinal axis extending parallel to said facets and respective end walls forming an integral molded structure and having an opening in one of said facets, the improvement comprising:

a) each of said end walls of said container having a respective tubular formation integrally molded and extending outwardly from its end wall with the axis of such tubular formations aligned with each other and defining a central longitudinal axis for said container, b) at least one circular gear formed with a hub, said gear engaging the outer surface of one of said tubular formations so as to dispose said gear with its central axis being substantially the central axis of said container, c) means for securing said circular gear to the end wall of said container adjacent which said gear is disposed on the tubular formation which is molded integral with said end wall with the central axis of said circular gear comprising the longitudinal axis of said container, and d) a bushing secured to the other end of said container and surrounding the other of said tubular containers, and e) an overhead support for said container defined by and assembly including first and second downwardly extending leg-formations and means for rotationally securing said gear and said bushing of said container to respective of said leg formations, said assembly including a motor and gear means driven by said motor and coupled to said circular gear secured to the end wall of said container for rotating said container about its central axis when said motor is operated.

* * * * *